US009532636B2

(12) United States Patent
Jung

(10) Patent No.: US 9,532,636 B2
(45) Date of Patent: Jan. 3, 2017

(54) COSMETIC CONTAINER HAVING AIRTIGHT REFILL CASE

(71) Applicant: Ku Youl Jung, Anyang-si (KR)

(72) Inventor: Ku Youl Jung, Anyang-si (KR)

( * ) Notice: Subject to any disclaimer, the term of this patent is extended or adjusted under 35 U.S.C. 154(b) by 0 days.

(21) Appl. No.: 14/651,218

(22) PCT Filed: Mar. 25, 2014

(86) PCT No.: PCT/KR2014/002479
§ 371 (c)(1),
(2) Date: Jun. 10, 2015

(87) PCT Pub. No.: WO2014/157901
PCT Pub. Date: Oct. 2, 2014

(65) Prior Publication Data

US 2016/0007717 A1 Jan. 14, 2016

(30) Foreign Application Priority Data

Mar. 26, 2013 (KR) ..... 10-2013-0032216

(51) Int. Cl.
*A45D 40/22* (2006.01)
*A45D 33/00* (2006.01)

(52) U.S. Cl.
CPC ..... *A45D 40/22* (2013.01); *A45D 33/006* (2013.01); *A45D 40/221* (2013.01); *A45D 2200/051* (2013.01)

(58) Field of Classification Search
CPC .... A45D 40/22; A45D 33/006; A45D 40/221; A45D 2200/051
USPC ..... 220/849, 259.2; 132/293
See application file for complete search history.

(56) References Cited

U.S. PATENT DOCUMENTS

| | | | | |
|---|---|---|---|---|
| 6,192,895 | B1 * | 2/2001 | Yuhara | A45C 13/008 132/294 |
| 731,405 | A1 | 1/2008 | Yuhara et al. | |
| 2004/0124200 | A1 * | 7/2004 | Yuhara | A45D 33/006 220/833 |

FOREIGN PATENT DOCUMENTS

| | | | |
|---|---|---|---|
| KR | 20-2000-0019770 | U | 11/2000 |
| KR | 20-0372923 | Y1 | 1/2005 |
| KR | 20-0429553 | Y1 | 10/2006 |
| KR | 10-1271359 | B1 | 6/2013 |
| WO | 99-20144 | A1 | 4/1999 |

* cited by examiner

*Primary Examiner* — James N Smalley
(74) *Attorney, Agent, or Firm* — John K. Park; Park Law Firm

(57) ABSTRACT

Provided is a cosmetic container having an airtight refill case that hermetically keeps a cosmetic such as a moisture-containing compact powder, a moisture-containing cream, and an eye shadow. More particularly, it relates to a cosmetic container having an airtight refill case 20 that is more hermetically sealed in a double airtight structure by coupling a lower main body 21 and an upper lid 25 of the refill case 20 with a butterfly hinge and by fitting an assembly groove part 22 having ring-shaped assembly protrusions 23 to an assembly protrusion part having ring-shaped assembly grooves 27 without a specific packing, in which the upper lid of the refill case is pressed by pressing protrusions 30 on the upper lid, when an outer container lid is closed.

4 Claims, 4 Drawing Sheets

COSMETIC CONTAINER HAVING AIRTIGHT REFILL CASE

TECHNICAL FIELD

The present invention relates to a cosmetic container having an airtight refill case that hermetically keeps a cosmetic such as a moisture-containing compact powder, a moisture-containing cream, and an eye shadow. More particularly, it relates to a cosmetic container having an airtight refill case that is tightly hermetically sealed in a double airtight structure by hermetically combining a lower main body and an upper lid of the refill case, which are connected by a butterfly hinge to prevent movement in vertical opening and closing operations, using an assembly groove part having ring-shaped assembly protrusions and an assembly protrusion part having ring-shaped assembly grooves without a specific packing; and by pressing the upper lid of the refill case a second time when an outer container lid is closed.

BACKGROUND ART

In general, cosmetics such as a compact, a cream, and an eye shadow are kept in cosmetic containers, but cosmetics are accompanied by those cosmetic containers when they are sold, so it is not economical.

Accordingly, there are many refill cases which are filled with a cosmetic and sold separately to be put into cosmetic containers.

However, existing refill cases are not sufficiently hermetically sealed, so they have a problem in that cosmetics especially a moisture-containing compact powder, a moisture-containing cream, and an eye shadow change in quality due to contact with external air or vaporization of the moisture or volatile components therein, and accordingly, they cannot be used for a long period of time.

Various types of cosmetic containers having an airtight refill case have been proposed to solve this problem.

For example, these include: a structure hermetically sealed by pressing a stepped portion of a lower main body with a packing on a coupling protrusion of an upper lid in Korean Utility Model Application Nos. 1998-20882, 1999-6499, and 1999-13511, and a structure hermetically sealed by pressing a packing on a lower main body with an upper lid in Korean Patent Application No. 2007-138275.

According to these structures, they are hermetically sealed by a separate packing, that is, they are hermetically sealed only by a single mechanism that simply presses upon a packing, so it is difficult to maximize airtightness. Further, particularly, when the packings loosen or wear, or they are not correctly assembled, airtightness is deteriorated.

DISCLOSURE

Technical Problem

Accordingly, the present invention has been made keeping in mind the above problems occurring in the related art, and the present invention is intended to propose a cosmetic container having an airtight refill case that is more hermetically sealed in a double airtight structure by coupling a lower main body and an upper lid of the refill case with a butterfly hinge to prevent movement in vertical opening and closing operations and by fitting an assembly groove part having ring-shaped assembly protrusions onto an assembly protrusion part having ring-shaped assembly grooves without a specific packing, particularly, combining the ring-shaped assembly protrusions and assembly grooves in a wedge type fashion.

The present invention is intended to more hermetically seal a refill case by forming a pressing protrusion on the top of an upper lid of the refill case so that the upper lid of the refill case is pressed and hermetically combined with a lower main body, when an outer container lid is closed.

Technical Solution

The present invention allows for more airtight combination of an upper lid and a lower main body by coupling the lower main body and the upper lid of a refill case with a butterfly hinge to prevent movement in vertical opening and closing operations and by fitting an assembly groove part having ring-shaped assembly protrusions onto an assembly protrusion part having ring-shaped assembly grooves without a specific packing, particularly, combining the ring-shaped assembly protrusions and assembly grooves in a wedge type fashion, and by forming pressing protrusions on the top of the upper lid of the refill case so that when an outer container lid is closed, the upper lid of the refill case is pressed to hermetically combine the upper lid and the lower main body; thereby more hermetically sealing the refill case.

Advantageous Effects

Since the refill case is hermetically sealed, external air cannot come in contact with a cosmetic in the refill case such as a moisture-containing compact powder, a moisture-containing cream, and an eye shadow; or the moisture or volatile components in the cosmetic do not vaporize, so the cosmetic can be used for a long period of time without changing in quality.

BEST MODE

Figure 1:
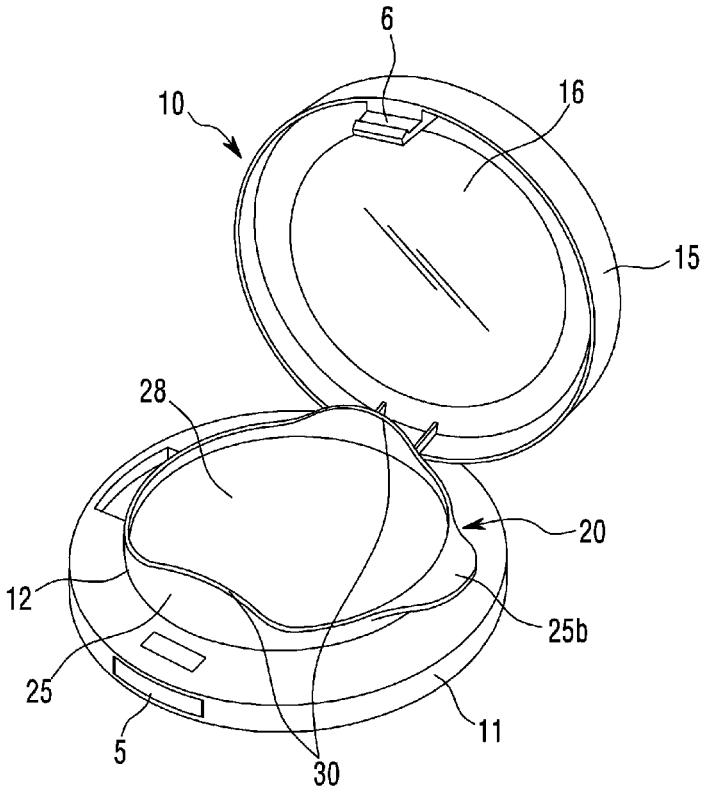
FIG. 1 is a perspective view showing an assembly of a container case of the present invention that is open.
Figure 2:
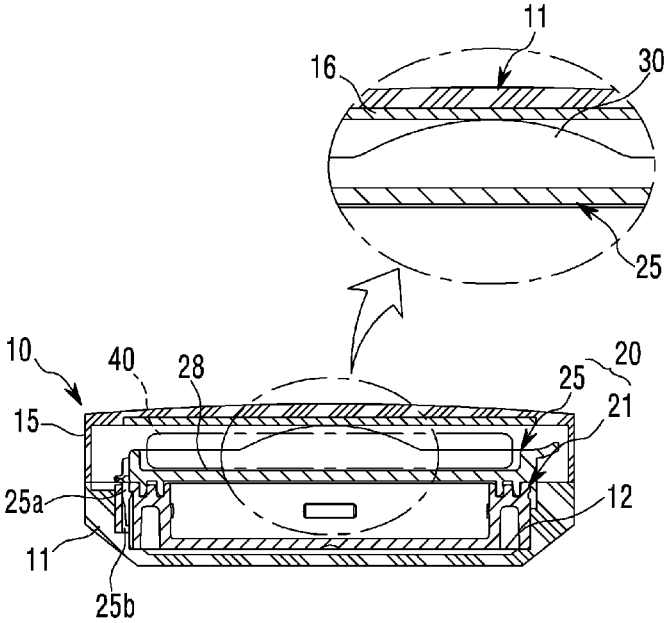
FIG. 2 is cross-sectional view of the assembly of FIG. 1.
Figure 3:
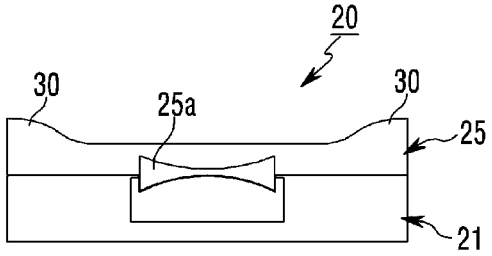
FIG. 3 is a rear view of a refill case of the present invention.
Figure 4:
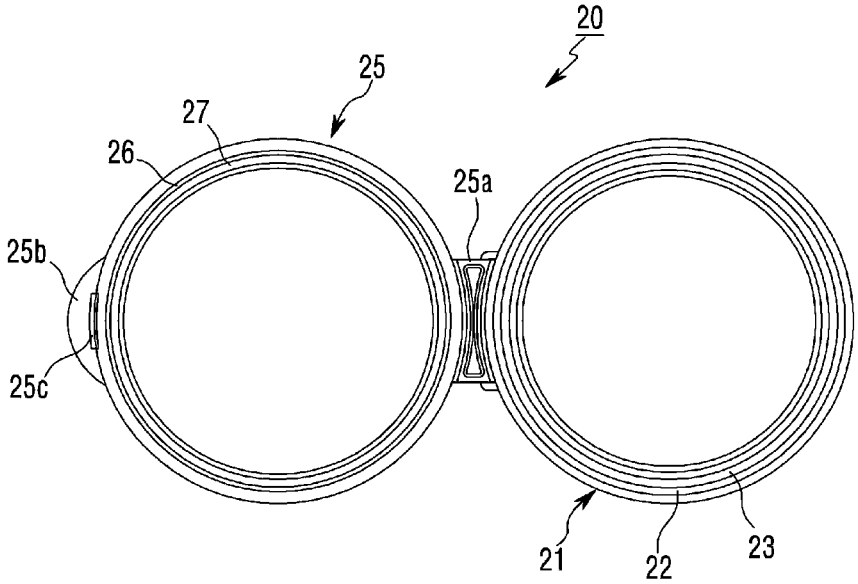
FIG. 4 is a plan view of the refill case FIG. 3 that is open.
Figure 5:
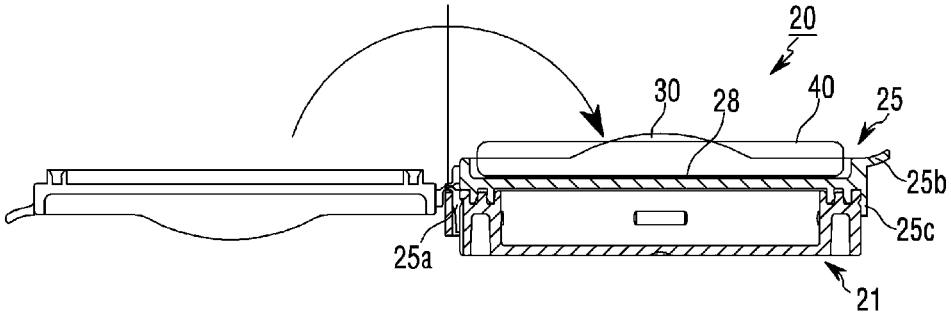
FIG. 5 is a side view of FIG. 3.
Figure 6:
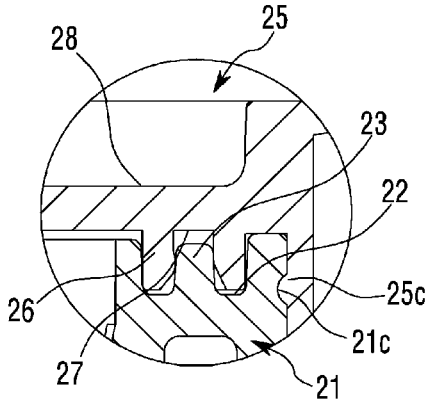
FIGS. 6 and 7 are enlarged views showing main parts of FIG. 5.
Figure 7:
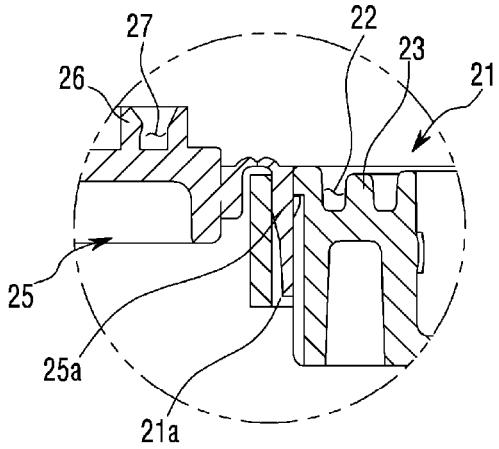

The present invention is characterized in that it is composed of a container main body and a container lid hinged to a side of the container main body and vertically opening and closing, a refill case having an upper lid connected to a side of a lower main body for keeping a cosmetic by a butterfly hinge and vertically opening and closing is inserted in a seat inside the container main body, and the refill case is doubly hermetically sealed by forming an assembly groove part having ring-shaped assembly protrusions around an edge of a top of the lower main body, forming an assembly protrusion part having ring-shaped assembly grooves where the assembly protrusions are inserted around an edge of a bottom of the upper lid, and by inserting the assembly protrusion part into the assembly groove part.

The present invention is characterized in that a pressing protrusion is formed at one or more positions on an edge of a top of the upper lid to hermetically combine the upper lid and the lower main body of the refill case by being pressed by a container lid, when the container lid is closed.

The present invention is characterized in that the pressing protrusions curvedly protrude on the edge of the upper lid at left and right sides perpendicular to a butterfly hinge and a knob on the upper lid.

The present invention is characterized in that the ring-shaped assembly protrusions of the lower main body have inner and outer inclined portions to be wedged into the assembly grooves of the upper lid.

The present invention is characterized in that the ring-shaped assembly grooves of the upper lid have inner and outer inclined portions to be fitted in a wedge type fashion onto the assembly protrusions of the lower main body.

Mode for Invention

Hereinafter, exemplary embodiments of the present invention will be described in detail with reference to the accompanying drawings.

A cosmetic container 10 having an airtight refill case of the present invention, as shown in FIGS. 1 to 7, includes a container main body 11 and a container lid 15 hinged to a side of the container main body and vertically opening and closing, and a refill case 20 that vertically opens/closes an upper lid 25 connected to a side of a lower main body 21 for keeping a cosmetic by a butterfly hinge is inserted in a seat 12 inside the container main body.

In particular, the refill case 20 is coupled to the lower main body 21 by inserting a butterfly hinge 25*a* on a side of the upper lid 25 into a vertical groove 21*a* at a side of the lower main body 21.

An assembly groove part 22 with ring-shaped assembly protrusions 23 is formed around the edge of the top of the lower main body 21 and an assembly protrusion part 26 with ring-shaped assembly grooves 27 where the assembly protrusions 23 are inserted is formed around the edge of the bottom of the upper lid 25, so the assembly protrusion portion 26 is inserted in the assembly groove portion 22 in a double airtight structure.

Figure 8:
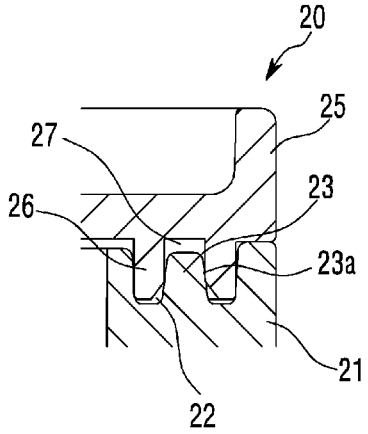
FIGS. 8 and 9 are enlarged cross-sectional views showing main parts in a wedging structure of the refill case of the present invention.
Figure 9:
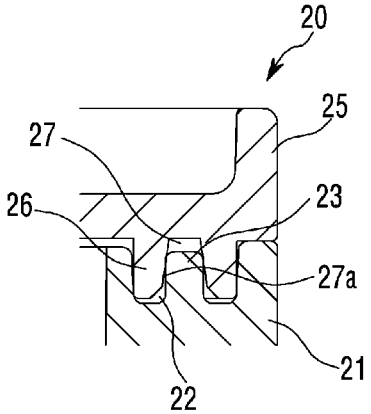

The ring-shaped assembly protrusions 23 of the lower main body 21, as in FIG. 8, have inner and outer inclined portions 23*a* to be wedged into the assembly grooves 27 of the upper lid 25, or the ring-shaped assembly grooves 27 of the upper lid 25, as in FIG. 9, have inner and outer inclined portions 27*a* to be fitted in a wedge type fashion onto the assembly protrusions 23 of the lower main body.

A pressing protrusion 30 is formed at one or more positions on the edge of the top of the upper lid 25 to hermetically combine the upper lid 25 and the lower main body 21 of the refill case 20 by being pressed by a container lid 15, when the container lid is closed.

It is preferable that pressing protrusions 30 curvedly protrude on the edge of the upper lid at left and right sides perpendicular to a butterfly hinge 25*a* and a knob 25*b* on the upper lid 25.

A puff seat 28 for keeping a puff is further formed on the top of the upper lid 25.

Further, it is preferable that the lower main body 21 is made of hard synthetic resin and the upper lid 25 is made of synthetic resin softer than the lower main body so that they are combined hermetically by the difference of the materials.

Figure 10:
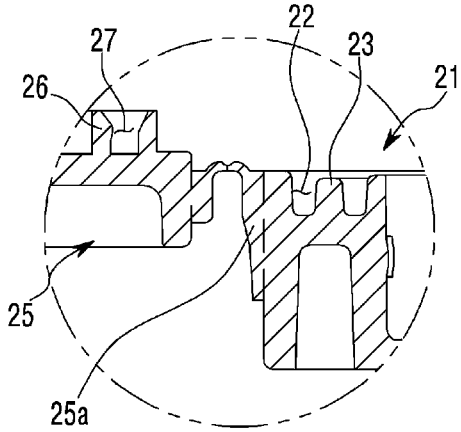
FIG. 10 is an enlarged cross-sectional view showing main parts of another example of a butterfly hinge for the refill case of the present invention.

Further, in the present invention, the butterfly hinge 25*a* may be integrated with the upper lid 25 and the lower main body 21, as shown in FIG. 10.

Though not stated above, a reference numeral '5' indicates a button type locking portion on the container main body 11 to lock or unlock a hook 6 on the container lid 15, a reference numeral '16' indicates a mirror, a reference numeral '40' indicates a puff, and a reference numeral '25*c*' indicates a locking protrusion formed at the lower portion of the knob 25*b* on the upper lid to be elastically locked into a locking groove 21*c* of the lower main body 21.

Next, operation of the present invention having this configuration is described hereafter.

The present invention is used in a refill type by putting the refill case 20 keeping a cosmetic such as a moisture-containing compact powder, a moisture-containing cream, and an eye shadow into the seat 12 inside the cosmetic container.

In particular, the present invention keeps a cosmetic for a long period of time without changing in quality by improving the airtight structure of the refill case 20 to prevent contact between a cosmetic and external air and prevent vaporization of moisture or volatile components in the cosmetic.

In more detail, the upper lid 25 and the lower main body 21 of the refill case 20 are combined by a butterfly hinge, that is, by inserting the butterfly hinge 25*a* on a side of the upper lie 25 into the vertical groove 21*a* at a side of the lower main body 21, so the upper lid is uniformly vertically opened and closed without moving, as compared with hinged structures of the related art.

Further, the upper lid 25 and the lower main body 21 of the refill case 20 are combined without a packing by inserting the assembly protrusion part 26 formed along the edge of the bottom of the upper lid into the assembly groove part 22 formed along the edge of the top of the lower main body.

In this configuration, the ring-shaped assembly protrusions 23 of the assembly groove part 22 on the lower main body are inserted in the ring-shaped assembly groove part 27 of the assembly protrusion part 26 on the upper lid, thereby achieving a double airtight structure.

Further, since the ring-shaped assembly protrusions 23 of the lower main body 21 have inner and outer inclined portions 23*a* to be wedged into the assembly grooves 27 of the upper lid 25, or the ring-shaped assembly grooves 27 of the upper lid 25 have inner and outer inclined portions 27*a* to be fitted in a wedge type fashion onto the assembly protrusions 23 of the lower main body, the assembly protrusions and the assembly grooves are more hermetically fitted.

By the structure of the refill case 20 described above, the upper lid 25 and the lower main body 21 are combined more hermetically.

In addition, since when the outer container lid 15 is closed, the pressing protrusions 30 on the top of the upper lid 25 of the refill case are pressed by the container lid 25, the upper lid 25 and the lower main body 21 of the refill case are more hermetically combined.

Since the pressing protrusions 30 are curvedly formed on the edge of the upper lid, at left and right positions perpendicular to the butterfly hinge 25*a* and the knob 25*b* on the upper lid 25, the entire upper lid 25 of the refill case is uniformly pressed, so the airtightness is more excellently ensured.

Further, according to the present invention, a puff is separately kept in the puff seat 28 on the top of the upper lid of the refill case 20, so spatial usability is improved. The puff seat has a space further ensured by the pressing protrusions 30 on the top of the upper lid 25, so the puff can be stably kept.

Therefore, by coupling the lower main body and the upper lid of the refill case with a butterfly hinge to prevent movement in vertical opening and closing operations, by fitting the assembly groove part having ring-shaped assembly protrusions onto the assembly protrusion part having ring-shaped assembly grooves without a specific packing, particularly, combining the ring-shaped assembly protrusions and assembly grooves in a wedge type fashion, and by forming the pressing protrusions on the top of the upper lid of the refill case, when the outer container lid is closed, the upper lid of the refill case is pressed so that the upper lid and the lower main body are hermetically combined, so the refill case is hermetically sealed.

Since the refill case is hermetically sealed, external air cannot come in contact with a cosmetic in the refill case such as a moisture-containing compact powder, a moisture-containing cream, and an eye shadow; or the moisture or volatile components in the cosmetic do not vaporize, so the cosmetic can be used for a long period of time without changing in quality.

The invention claimed is:

1. A cosmetic container having an airtight refill case, comprising:

a container main body (11); and a container lid (15) hinged to a side of the container main body and vertically opening and closing, wherein a refill case (20) having an upper lid (25) connected to a side of a lower main body (21) for keeping a cosmetic by a butterfly hinge and vertically opening and closing is inserted in a seat (12) inside the container main body, and the refill case (20) is doubly hermetically sealed by forming an assembly groove part having ring-shaped assembly protrusions (23) around an edge of a top of the lower main body (21), forming an assembly protrusion part (26) having ring-shaped assembly grooves (27) where the assembly protrusions (23) are inserted around an edge of a bottom of the upper lid (25), and inserting the assembly protrusion part (26) into the assembly groove part (22), wherein a pressing protrusion (30) is formed at one or more positions on an edge of a top of the upper lid (25) to hermetically combine the upper lid (25) and the lower main body (21) of the refill case (20) by being pressed by a container lid, when the container lid (15) is closed.

2. The cosmetic container of claim 1, wherein the pressing protrusions (30) curvedly protrude on the edge of the upper lid at left and right sides perpendicular to a butterfly hinge (25*a*) and a knob (25*b*) on the upper lid (25).

3. The cosmetic container of claim 1, wherein the ring-shaped assembly protrusions (23) of the lower main body (21) have inner and outer inclined portions (23*a*) to be wedged into the assembly grooves (27) of the upper lid (25).

4. The cosmetic container of claim 1, wherein the ring-shaped assembly grooves (27) of the upper lid (25) have inner and outer inclined portions (27*a*) to be fitted in a wedge type fashion onto the assembly protrusions (23) of the lower main body.

* * * * *